US012078415B2

(12) United States Patent
Briglia et al.

(10) Patent No.: US 12,078,415 B2
(45) Date of Patent: Sep. 3, 2024

(54) PROCESS AND APPARATUS FOR THE SEPARATION OF AIR BY CRYOGENIC DISTILLATION

(71) Applicants: L'Air Liquide, Societe Anonyme pour l'Etude et l'Exploitation des Procedes Georges Claude, Paris (FR); Alain Briglia, Hangzhou (CN); Fengjie Xue, Hangzhou (CN); Jianwei Cao, Hangzhou (CN); Baptiste Fara, Champigny sur Marne (FR)

(72) Inventors: Alain Briglia, Hangzhou (CN); Fengjie Xue, Hangzhou (CN); Jianwei Cao, Hangzhou (CN); Baptiste Fara, Champigny sur Marne (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 326 days.

(21) Appl. No.: 17/630,433

(22) PCT Filed: Jul. 26, 2019

(86) PCT No.: PCT/CN2019/097997
§ 371 (c)(1),
(2) Date: Jan. 26, 2022

(87) PCT Pub. No.: WO2021/016756
PCT Pub. Date: Feb. 4, 2021

(65) Prior Publication Data
US 2022/0282914 A1 Sep. 8, 2022

(51) Int. Cl.
*F25J 3/04* (2006.01)

(52) U.S. Cl.
CPC ..... *F25J 3/04412* (2013.01); *F25J 3/0409* (2013.01); *F25J 3/04296* (2013.01);
(Continued)

(58) Field of Classification Search
CPC .... F25J 3/04412; F25J 3/0409; F25J 3/04296; F25J 3/04387; F25J 3/04381;
(Continued)

(56) References Cited

U.S. PATENT DOCUMENTS 4,705,548 A * 11/1987 Agrawal ..... F25J 3/04351 62/924
5,735,142 A 4/1998 Grenier
(Continued)

FOREIGN PATENT DOCUMENTS

CN 1 208 847 2/1999
CN 107 940 896 4/2018
(Continued)

OTHER PUBLICATIONS

International Search Report and Written Report for PCT/CN2019/097997, mailed Apr. 10, 2020.

*Primary Examiner* — Miguel A Diaz
(74) *Attorney, Agent, or Firm* — Justin K. Murray

(57) ABSTRACT

An apparatus for the separation of air by cryogenic distillation comprises a column system, a heat exchanger, a turbine, means for sending compressed and purified air at a first pressure to be cooled at the first pressure in the heat exchanger, means for sending a first gaseous stream having a nitrogen content at least that of air to be cooled and liquefied or pseudo liquefied in the heat exchanger to form a liquefied stream, means for sending at least part of the liquefied stream to be warmed and vaporized in the heat exchanger to a first intermediate temperature of the heat exchanger to form a vaporized stream, means for removing the vaporized stream from an intermediate section of the heat exchanger, a conduit for sending the vaporized stream to be expanded, in the turbine to form an expanded stream, a conduit for sending at least part of the expanded stream to the column system, a conduit for sending a second gaseous
(Continued)

stream having the same nitrogen content as the first stream to be cooled in the heat exchanger, means for removing at least part of the second gaseous stream from an intermediate section of the heat exchanger at a second intermediate temperature and sending the second gaseous stream to the turbine to be expanded with the vaporized stream.

15 Claims, 4 Drawing Sheets

(52) U.S. Cl.
CPC ..... *F25J 3/04387* (2013.01); *F25J 2205/02* (2013.01); *F25J 2240/10* (2013.01); *F25J 2240/12* (2013.01); *F25J 2245/40* (2013.01); *F25J 2245/42* (2013.01)

(58) Field of Classification Search
CPC .. F25J 3/04375; F25J 2205/02; F25J 2240/12; F25J 2240/10; F25J 2245/40; F25J 2245/42
See application file for complete search history.

(56) References Cited

U.S. PATENT DOCUMENTS

| | | | | |
|---|---|---|---|---|
| 6,110,980 | A | 8/2000 | Chen | |
| 2005/0126221 | A1* | 6/2005 | Ha | F25J 3/04412 62/646 |
| 2008/0223075 | A1* | 9/2008 | Tranier | F25J 3/0409 62/644 |
| 2011/0067444 | A1* | 3/2011 | Alekseev | F25J 3/0409 62/646 |
| 2020/0333069 | A1 | 10/2020 | Dubettier-Grenier et al. | |

FOREIGN PATENT DOCUMENTS

| | | |
|---|---|---|
| CN | 108 759 308 | 11/2018 |
| CN | 208 443 098 | 1/2019 |
| CN | 109 442 867 | 3/2019 |
| CN | 109 737 690 | 5/2019 |
| DE | 3 307 181 | 9/1984 |
| EP | 0 789 208 | 8/1997 |
| FR | 3 072 451 | 4/2019 |
| GB | 0 302 267 | 3/2003 |

* cited by examiner

[FIG.1]
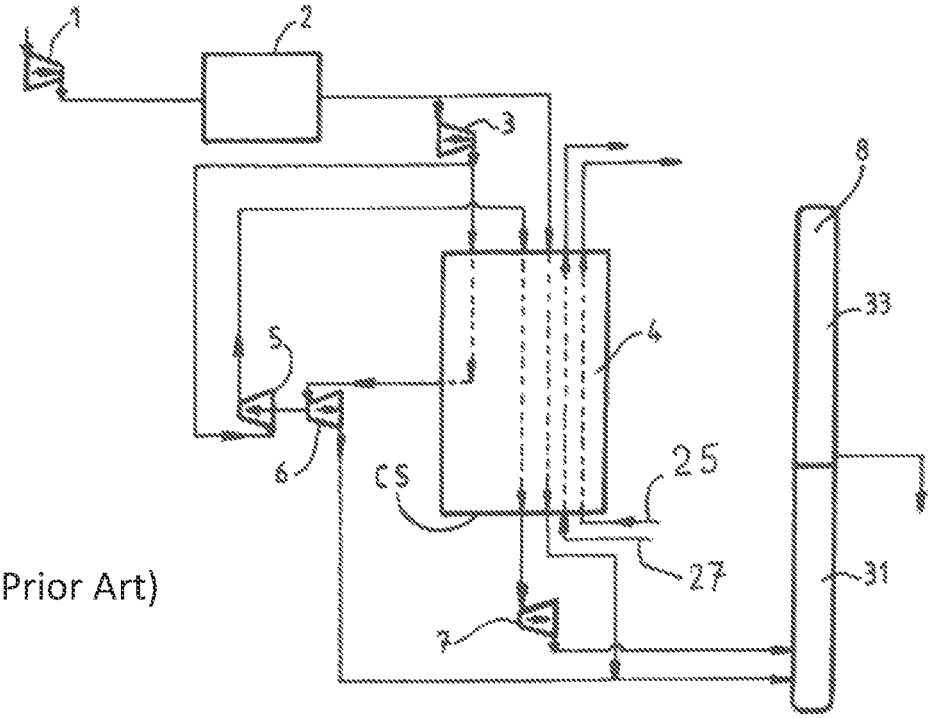
(Prior Art)
[FIG.2]
(Prior Art)
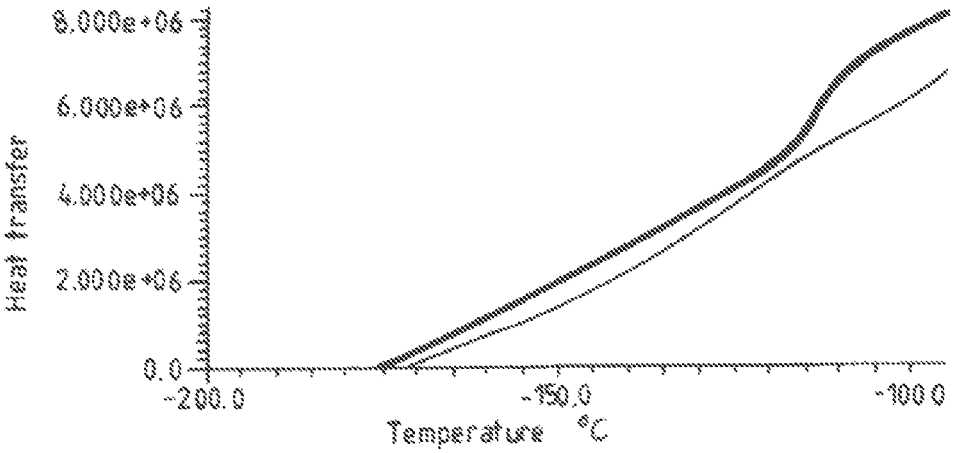

[FIG.3]
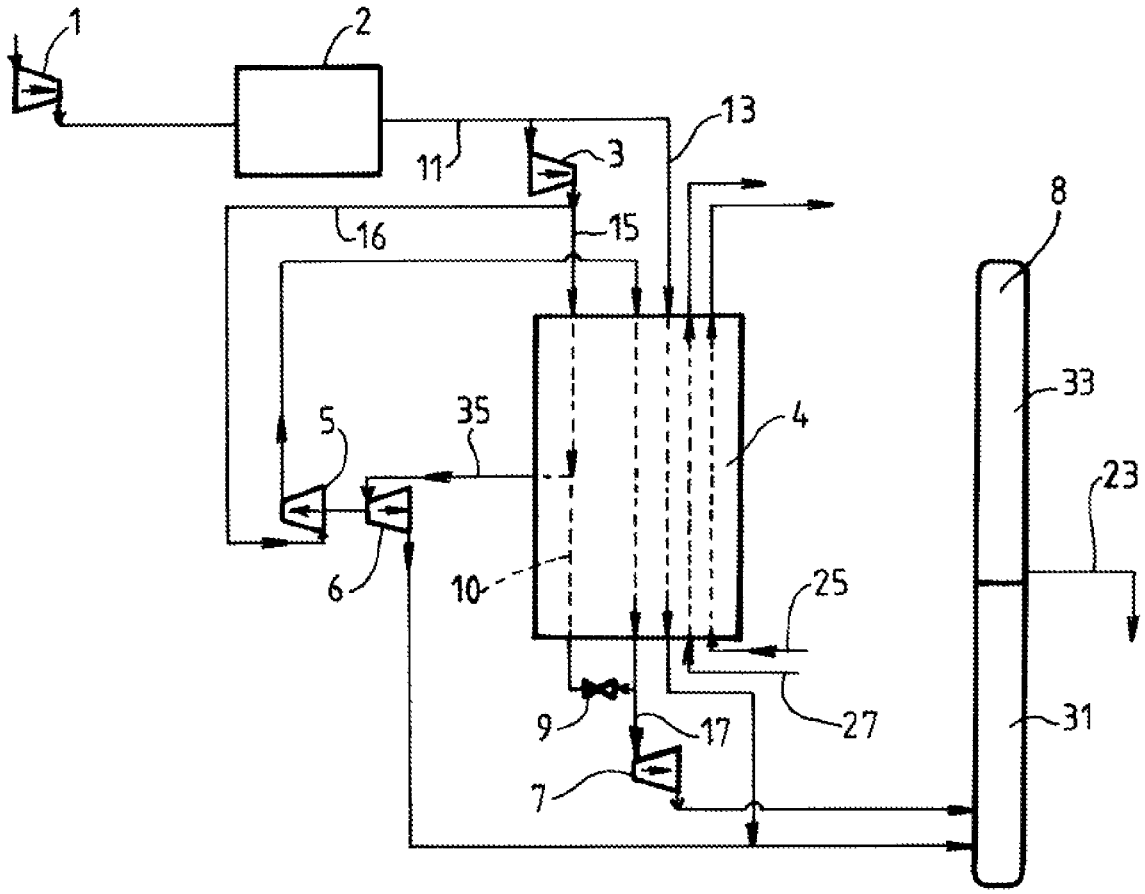
[FIG.4]
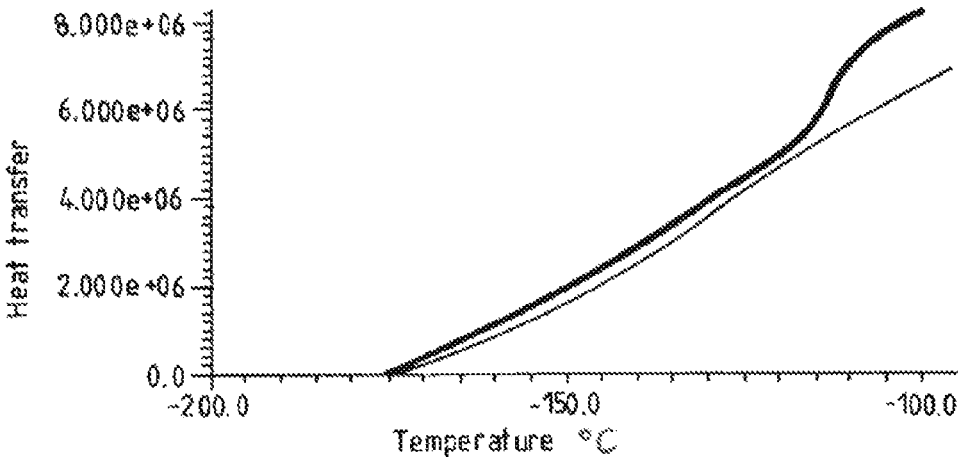

[FIG.5]
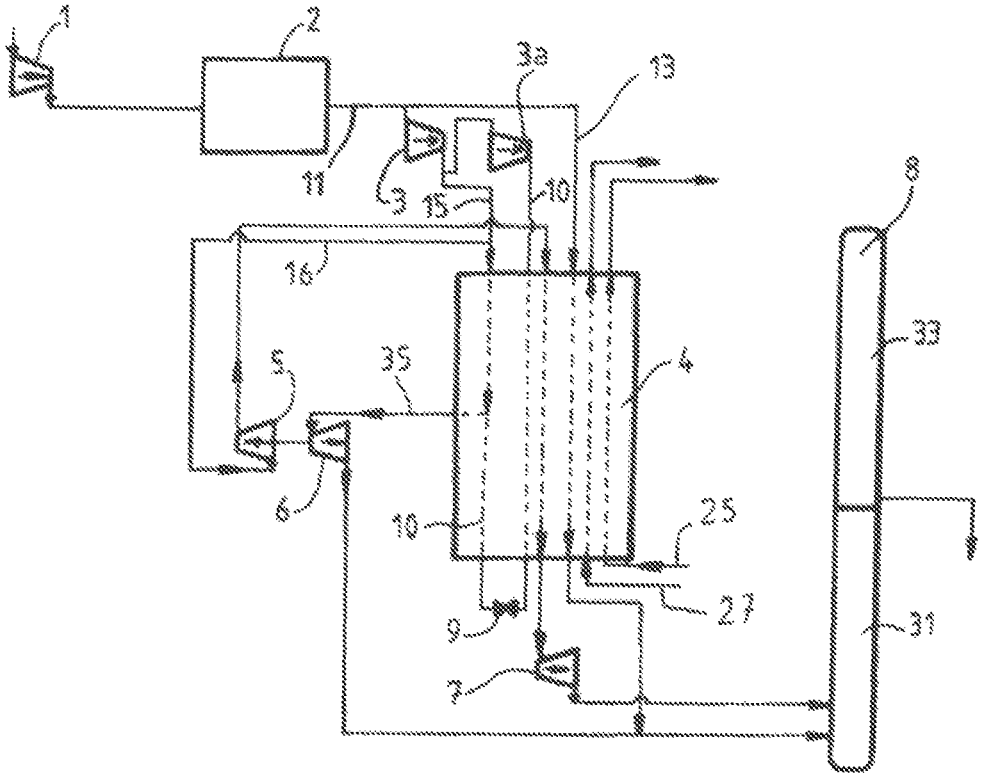

[FIG.6]
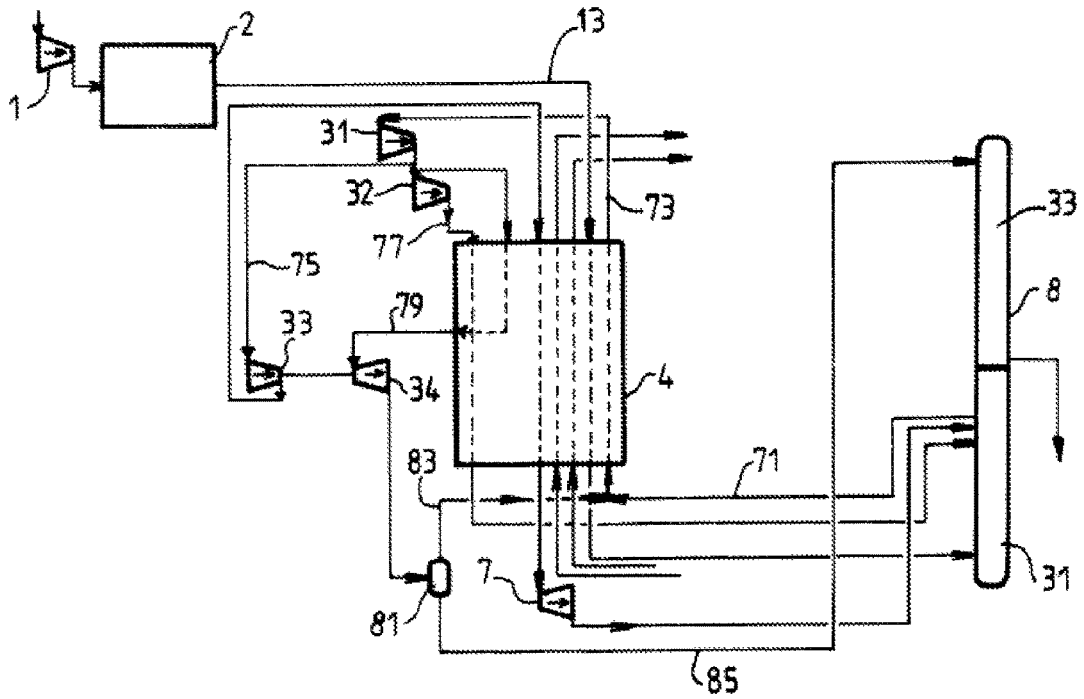
[FIG.7]
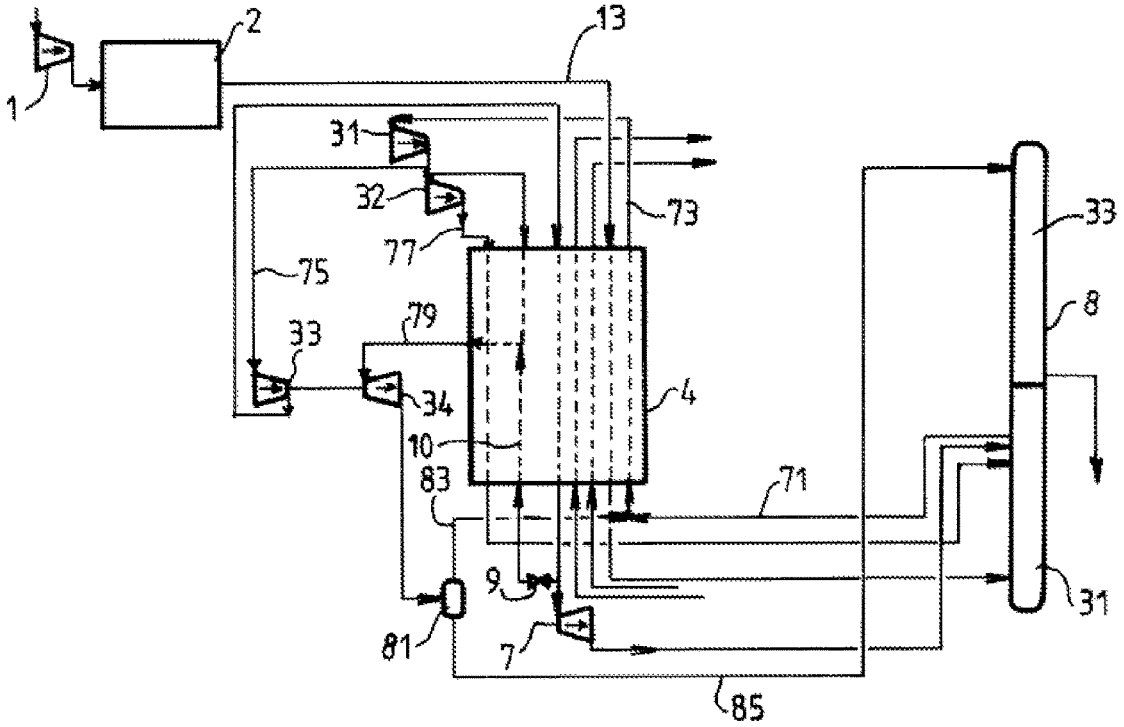

PROCESS AND APPARATUS FOR THE SEPARATION OF AIR BY CRYOGENIC DISTILLATION

CROSS REFERENCE TO RELATED APPLICATIONS

This application is a § 371 of International PCT Application PCT/CN2019/097997, filed Jul. 26, 2019, which is herein incorporated by reference in its entirety.

FIELD OF THE INVENTION

The present invention relates to the separation of air by cryogenic distillation.

BACKGROUND OF THE INVENTION

Production of industrial gases such as oxygen, nitrogen and argon in gaseous form under any pressure or in liquefied form consumes a large amount of energy.

According to requirements, a multitude of process cycles can be used.

The energy used for the production of industrial gases can be split into three parts:

The separation energy, which is the energy given to the system to perform the separation of the component of the air The compression energy, which is the energy given to the system to perform the compression of the products, The liquefaction energy, which is the energy given to the system to perform the liquefaction of the products.

The separation energy is mainly linked to the various columns and set-up of those columns to perform the separation, and is mainly provided by the Main Air Compressor (MAC)

The compression and liquefaction energy is mainly linked to the heat exchanger and various machines such as expanders, gas or liquid, and compressors set-up and arrangement.

Since the OPEX have a large impact on the economics of an air separation unit (ASU), with the constant increase of cost of energy, there are always incentives to make the process more efficient.

The process of FIG. 1 is known from EP789208. In this process, an air compressor 1 compresses the feed air to a pressure slightly above the pressure of a first column 31. The first column forms part of a classic double column 8 in which the first column operates at a first pressure and a second column 33 operates at a second pressure, lower than the first pressure. The nitrogen gas from the top of the first column is used to heat a bottom condenser of the second column and is then returned to the first column in liquid form (not shown).

Air is fed to the first column where it is separated to form an oxygen enriched liquid and a nitrogen enriched gas. Nitrogen enriched liquid and oxygen enriched liquid are sent from the first column to the second column. Liquid oxygen is withdrawn from the bottom of the second column.

At least part of the liquid oxygen is pressurized and sent to a heat exchanger 4 to be vaporized to form product oxygen. Gaseous nitrogen from the first and/or second column is also warmed in the heat exchanger 4.

Air from main air compressor 1 is purified in purification unit 2 to remove carbon dioxide and water and is then divided in two. One part passes through the heat exchanger 4 at the outlet pressure of compressor 1 and is sent in gaseous form to first column 31. The rest of the air is sent to a booster compressor 3 in which it is compressed to a higher pressure and then divided in two. The first part is further boosted, in booster 5, without having been cooled in the heat exchanger 4, and is then sent to the warm end of the heat exchanger 4 where it liquefies or becomes a dense fluid, depending on the pressure. The liquefied air or dense fluid removed from the cold end within a cold section CS of the heat exchanger 4 is expanded in an expander 7 and is then sent to the first column.

The second part of the air from the booster 5 is sent to the warm end of the heat exchanger without further compression and is removed from the heat exchanger 4 at an intermediate position. It is then expanded in a Claude turbine 6 and sent to the first column 31 after being mixed with the stream coming directly from the main air compressor 1.

A gaseous nitrogen stream 27 from the column 31 and/or 33 is warmed in the heat exchanger 4 (not shown).

When analyzing the heat exchanger diagram of this process scheme, by doing an exergy analysis of the cold section CS of the main heat exchanger 4, it is found that irreversibilities occur in this cold section. FIG. 2 shows the relation between the heat transfer and the temperature for this cold section. For all the heat exchange diagrams of this document, the temperature in ° C. is shown on the x-axis and the heat transfer on the y-axis.

SUMMARY OF THE INVENTION

Certain embodiments of the present invention aims mainly to improve the liquefaction energy and/or the compression energy of the product by reducing the irreversibilities in the cold section of the exchanger.

According to an embodiment of the invention, there is provided a process for the separation of air by cryogenic distillation in which:

i) Compressed and purified air is cooled at a first pressure in a heat exchanger and the cooled air is sent in gaseous form from the heat exchanger to a column system comprising at least one distillation column ii) A gaseous nitrogen stream from the column system is warmed in the heat exchanger iii) A liquid stream enriched in oxygen or nitrogen from the column system is vaporized and warmed in the heat exchanger iv) A first gaseous stream having a nitrogen content at least that of air and at a higher pressure than the first pressure is cooled and liquefied or pseudo liquefied in the heat exchanger to form a liquefied stream v) At least part of the liquefied stream of step iii) is warmed and vaporized in the heat exchanger to a first intermediate temperature of the heat exchanger to form a vaporized stream vi) The vaporized stream is expanded, at least in part, in a turbine to form an expanded stream and at least part of the expanded stream is sent to the column system vii) A second gaseous stream having the same nitrogen content as the first stream is cooled in the heat exchanger, at least part of the second gaseous stream is removed from the heat exchanger at a second intermediate temperature and is sent to the turbine to be expanded with the vaporized stream and viii) A further stream having a nitrogen content at least that of air is liquefied or pseudoliquefied in the heat exchanger, expanded and sent to the column system.

According to other optional features, which may be combined in any logical manner:

the column system comprises a first column operating at a pressure no more than 4 bars below the first pressure the column system comprises a first column operating at a pressure substantially equal to the first pressure the column system comprises a second column operating at a second pressure lower than the pressure of the second column.

the first gaseous stream at the higher pressure and the second gaseous stream are both air streams and the expanded stream of step v) is sent to the first column.

the first gaseous stream at the higher pressure and the second gaseous stream are both nitrogen rich streams having a nitrogen content richer than that of air, at least one of which having being withdrawn from the first and/or second column.

the first intermediate temperature is higher than the second intermediate temperature, equal to the second intermediate temperature or less than the second intermediate temperature.

a gaseous stream is compressed in a first compressor to a second pressure higher than the first pressure and then divided to form the first and second gaseous streams.

the first gaseous stream is further compressed in a second compressor to a third pressure higher than the second pressure before being cooled in the heat exchanger.

the second compressor is coupled to the turbine.

the second gaseous stream is cooled in the heat exchanger at the second pressure the second pressure is the inlet pressure of the turbine.

the first pressure is substantially equal to the pressure of the column of the column system operating at the highest or higher pressure.

the outlet pressure of the turbine is substantially equal to the pressure of a column of the column system, preferably to the pressure of the column operating at the highest or higher pressure.

the at least part of the liquefied stream of step iii) is expanded before being warmed and vaporized in the heat exchanger by a valve or a turbine the vaporized stream and the at least part of the cooled second gaseous stream are mixed upstream of the turbine the vaporized stream and the cooled second gaseous stream are mixed in the heat exchanger all of the compressors of the process have inlet temperatures above 0° C.

the column system includes an argon column all of the second gaseous stream is sent to the turbine the second gaseous stream is liquefied or pseudoliquefied and part of the liquefied stream is vaporized to form the vaporized stream part of the liquefied or pseudoliquefied stream constitutes the further stream the liquefied or pseudoliquefied stream is divided in at least two parts, one of which forms the further stream and one of which forms the stream to be vaporized the liquefied or pseudoliquefied stream is divided downstream of the heat exchanger the further stream and the stream to be vaporized are both expanded separately to different pressures the heat exchanger is comprised of first and second heat exchange sections wherein the compressed and purified air is cooled at the first pressure in the first heat exchange section and the cooled air is sent from the first heat exchange section to the column system comprising at least one distillation column, gaseous nitrogen stream from the column system is warmed in the first and/or second heat exchange sections, the liquid stream enriched in oxygen or nitrogen from the column system is vaporized and warmed in the first heat exchange section, the first gaseous stream having a nitrogen content at least that of air and at a higher pressure than the first pressure is cooled and liquefied or pseudo liquefied in the second heat exchange section to form a liquefied stream, at least part of the liquefied stream is warmed and preferably vaporized in the second heat exchange section to the first intermediate temperature of the second heat exchange section to form the vaporized stream, the second gaseous stream having the same nitrogen content as the first stream is cooled in the second heat exchange section and at least part of the second gaseous stream is removed from the second heat exchange section at the second intermediate temperature.

the heat exchanger is comprised of first and second heat exchange sections wherein any warming air stream, cooling air stream or warming stream produced by the column system above a given pressure is cooled or warmed respectively in the first heat exchange section.

the first and second gaseous streams are air and the expanded air from the turbine is mixed with the air stream at the first pressure before being sent to the column system.

the vaporized stream is expanded, at least in part, in a turbine to form an expanded stream at substantially the second pressure.

all the feed air is pressurized to at least the first pressure.

the first and second intermediate temperatures are chosen in the range from −70° C. to −140° C., preferably in the range −90° C. to −120° C.

the inlet pressure of the turbine is between 15 bara and 65 bara . . . .

According to an embodiment of the invention, there is provided an apparatus for the separation of air by cryogenic distillation comprising a column system comprising at least one column, a heat exchanger, a turbine, means for sending compressed and purified air at a first pressure to be cooled at the first pressure in the heat exchanger, means for sending the cooled air in gaseous form from the heat exchanger to the column system, means for sending a gaseous nitrogen stream from the column system to be warmed in the heat exchanger, means for sending a liquid stream enriched in oxygen or nitrogen from the column system to be vaporized and warmed in the heat exchanger, means for sending a first gaseous stream having a nitrogen content at least that of air and at a higher pressure than the first pressure to be cooled and liquefied or pseudo liquefied in the heat exchanger to form a liquefied stream, means for sending at least part of the liquefied stream to be warmed and vaporized in the heat exchanger to a first intermediate temperature of the heat exchanger to form a vaporized stream, means for removing the vaporized stream from an intermediate section of the heat exchanger, a conduit for sending the vaporized stream to be expanded, at least in part, in the turbine to form an expanded stream, a conduit for sending at least part of the expanded stream to the column system, a conduit for sending a second gaseous stream having the same nitrogen content as the first stream to be cooled in the heat exchanger, conduit means for removing at least part of the second gaseous stream from an intermediate section of the heat exchanger at a second intermediate temperature and sending the at least part of the second gaseous stream to the turbine to be expanded with the vaporized stream, conduit means for sending a further stream having a nitrogen content at least that of air to be liquefied or pseudoliquefied in the heat exchanger, expansion means, means for sending the further stream to the expansion means and conduit means for sending the expanded further stream to the column.

The apparatus may further comprise:

- the column system comprising a column operating a column pressure and a column operating at a pressure lower than the column pressure, the columns being thermally linked
- means for withdrawing a final liquid product from the column system
- purification means for removing water and carbon dioxide from the feed air at the first pressure
- means for mixing the streams at the first and second intermediate temperatures upstream of the turbine and downstream of the heat exchanger
- means for mixing the streams at the first and second intermediate temperatures within the heat exchanger
- the heat exchanger is a brazed aluminium plate fin heat exchanger
- the heat exchange is comprised of first and second heat exchange sections and means for sending fluids to be warmed from the column system to each heat exchange section The present invention is described here as a modification of various different cryogenic air separation processes.

This invention of course can be used other process scheme without any limitation.

The current invention may include recycling to the cold section a stream which is vaporized preferably prior to being injected in the turbo expander inlet. This stream being preferably high pressure air, this allows the irreversibilities to be reduced in the cold section of the main heat exchanger, leading in the studied case to an improvement of 1% for the total energy of the ASU

BRIEF DESCRIPTION OF THE DRAWINGS

Further features, advantages and possible applications of the invention are apparent from the following description of working and numerical examples and from the drawings. All described and/or depicted features on their own or in any desired combination form the subject matter of the invention, irrespective of the way in which they are combined in the claims or the way in which said claims refer back to one another.

FIG. 1 provides an embodiment of the prior art.

FIG. 2 shows the relation between the heat transfer and the temperature for a cold section of FIG. 1.

FIG. 3 provides an embodiment of the present invention.

FIG. 4 shows the relation between the heat transfer and the temperature for a cold section of FIG. 3.

FIG. 5 shows a process in accordance with an embodiment of the present invention.

FIG. 6 shows a comparative figure.

FIG. 7 provides a process in accordance with an embodiment of the present invention.

DETAILED DESCRIPTION OF THE INVENTION

Certain embodiments of the invention will now be described in greater detail with reference to FIGS. 3 to 6, where FIGS. 3, 5 and 7 show processes operating according to the invention, FIG. 6 shows a comparative figure and FIG. 4 shows a heat exchange diagram for the cold section of the heat exchanger of FIG. 3.

The scheme of FIG. 3 is similar to the base case of FIG. 1, but includes a high-pressure liquid air stream which is removed from the cold end of the heat exchanger 4 and separated in two. One part 10 is sent back to the heat exchanger after expansion in a valve 9 and is vaporized in the heat exchanger 4, prior to being mixed with the stream coming from the Booster air Compressor (BAC) 3 and before being expanded in the turbo-expander 6. It is also possible to send the vaporized liquid air stream to the turbine 6 without mixing it with any other stream.

Air from main air compressor 1 is purified in purification unit 2 to remove carbon dioxide and water and is then divided in two. One part 13 passes through the heat exchanger 4 at the outlet pressure of compressor 1 and is sent in gaseous form to first column 31. The rest of the air is sent to a booster compressor 3 in which it is compressed to a higher pressure and then divided in two. The first part 16 is further boosted, in booster 5, without having been cooled in the brazed aluminium plate fin heat exchanger 4, and is then sent to the warm end of the heat exchanger 4 where it liquefies or becomes a dense fluid, depending on the pressure. The liquefied air or dense fluid removed from the cold end of the heat exchanger 4 is divided in two. One part 17 is expanded in an expander 7 and is then sent to the first column. The other part 9 is expanded in a valve 9 and then sent to the cold end of the heat exchanger 4 in which it is vaporized. The vaporized air is mixed with air stream 15 within the heat exchanger 4 to form stream 35 which is removed from the heat exchanger at an intermediate temperature of the heat exchanger for example between −70° C. and −140° C. and then sent to the turbine 6 at a pressure between 15 and 65 bara without any further cooling or expansion.

The second part 15 of the air from the booster 5 is sent to the warm end of the heat exchanger without further compression, is cooled to between −70° C. and −140° C. and is removed from the heat exchanger 4 at an intermediate position, having already been mixed with stream 10. The mixed stream 35 is then expanded, as already described, in the Claude turbine 6 to the pressure of column 31 and sent to the first column after being mixed with the stream coming directly from the main air compressor.

In this particular case, stream 15 is cooled to an intermediate temperature in the heat exchanger 4 and stream 10 is warmed to the same intermediate temperature.

It is possible for the streams to be warmed and cooled to slightly different temperatures, for example differing by 1 or 2° C.

The streams may be mixed within the heat exchanger, outside the heat exchanger or on reaching the turbine.

The outlet pressure of booster 3 and the outlet pressure of the valve on stream 10 are necessarily substantially equal, allowing for pressure drop within the heat exchanger 4.

The outlet pressure of booster 3 is equal to the inlet pressure of turbine 6, allowing for the pressure drop of stream 15 in the heat exchanger 4.

A liquid oxygen stream 25 from the bottom of column 33 is vaporized in the heat exchanger 4 and warmed to form a product stream, preferably under pressure. The liquid oxygen stream 25 can be replaced by a liquid nitrogen stream withdrawn from column 31 or 33. A gaseous nitrogen stream 27 from the first and/or second column is warmed in the heat exchanger 4.

| | 10 | 11 | 13 | 15 | 16 | 17 | 35 |
|---|---|---|---|---|---|---|---|
| Flow [Nm3/h] | 14000 | 316000 | 130000 | 78000 | 108000 | 94000 | 92000 |
| Temp [deg C.] | — | 23 | 23 | 22 | 22 | −174 | −101 |
| Pressure [bara] | — | 5.3 | 5.3 | 49 | 49 | 72 | 48.5 |

FIG. 4 shows a much improved heat exchange diagram for the process of FIG. 3, in comparison with FIG. 2.

It can also be envisaged that stream 10 is vaporized and then warms up to the warm end of the heat exchanger 4 before being mixed with the stream 15 going to the turbine 6. It can also be imagined that this stream 10 is removed from the heat exchanger 4 at a lower temperature than that at which the stream 15 is removed.

The valve 9 can be replaced by a dense liquid expander to further improve the plant efficiency.

In the process of FIG. 5, an additional booster section 3*a* is added to compress the stream 10 which is to be liquefied and revaporized in the heat exchanger. In this way the inlet of the dense fluid expander 7 and the fluid 10 can be at different pressures. Here the inlet pressure of the turbine 7 is slightly lower than the outlet pressure of booster 5.

Air from main air compressor 1 is purified in purification unit 2 to remove carbon dioxide and water and is then divided in two. One part 13 passes through the heat exchanger 4 at the outlet pressure of compressor 1 and is sent in gaseous form to first column 31. The rest of the air is sent to a booster compressor 3 in which it is compressed to a higher pressure and then divided in three. The first part 16 is further boosted, in booster 5, without having been cooled in the heat exchanger 4, and is then sent to the warm end of the heat exchanger 4 where it liquefies or becomes a dense fluid, depending on the pressure. The liquefied air or dense fluid removed from the cold end of the heat exchanger 4, is expanded in an expander 7 and is then sent to the first column.

The second part 10 of the air from booster 3 is sent to a further booster 3*a* where it is further compressed. The further compressed air 10 is cooled by passing from the warm end to the cold end of the heat exchanger. On leaving the heat exchanger, it is expanded in a valve and then sent to the cold end of the heat exchanger 4 in which it is vaporized and warmed to between −70° C. and −140° C. The vaporized air 10 is mixed with air stream 15 to form stream 35 which is then sent to the turbine 6 at a pressure between 15 and 65 bara.

The third part 15 of the air from the booster 5 is sent to the warm end of the heat exchanger without further compression and is removed from the heat exchanger 4 at an intermediate position, having already been mixed with stream 10. The mixed stream 35 is then expanded, as already described, in the Claude turbine 6 and sent to the first column after being mixed with the stream coming directly from the main air compressor.

In this particular case, stream 15 is cooled to an intermediate temperature in the heat exchanger 4 and stream 10 is warmed to the same intermediate temperature.

It is possible for the streams 10,15 to be warmed and cooled to slightly different temperatures for example differing by 1 or 2° C.

The streams may be mixed within the heat exchanger, outside the heat exchanger or on reaching the turbine.

The outlet pressure of booster 3 and the outlet pressure of the valve on stream 10 are necessarily substantially equal and are chosen to be between 15 and 65 bara.

The outlet pressure of booster 3 is equal to the inlet pressure of turbine 6.

A liquid oxygen stream 25 from the bottom of column 33 is vaporized in the heat exchanger 4 and warmed to form a product stream, preferably under pressure. The liquid oxygen stream 25 can be replaced by a liquid nitrogen stream withdrawn from column 31 or 33. A gaseous nitrogen stream 27 from the first and/or second column is warmed in the heat exchanger 4.

It can also be envisaged that stream 10 is vaporized and then warms up to the warm end of the heat exchanger 4 before being mixed with the stream 15 going to the turbine 6. It can also be imagine that this stream 10 is removed from the heat exchanger 4 at a lower temperature than that at which the stream 15 is removed.

The valve 9 can be replaced by a dense liquid expander to further improve the plant efficiency.

This set-up shows a slight improvement, but has a CAPEX impact due to the additional BAC section 3*a*.

FIG. 6 shows an example of a figure similar to FIG. 1 where the refrigeration is provided by a nitrogen cycle. Here the air 13 is cooled in the heat exchanger and sent to column 31 without any expansion. Instead a nitrogen stream 71 from the top of column 31 is warmed in the heat exchanger to form stream 73 and is compressed in a compressor 31. The compressed stream is divided in three, one part being compressed in compressor 33, another in compressor 32 and the rest 79 being cooled in the warm section of the heat exchanger 4.

Stream 79 is removed from the heat exchanger 4 and expanded in nitrogen turbine 34 to form a partially condensed fluid which is sent to phase separator 81. The liquid from the phase separator is sent to the top of the second column 33 as reflux 85. The gas 83 from the phase separator 81 is mixed with the nitrogen 71.

The gas compressed in compressor 33 is fully cooled in the heat exchanger 4, liquefied and expanded in liquid turbine 7 before being sent to the top of the first column 31 as reflux.

The gas 77 compressed in compressor 32 is fully cooled in heat exchanger is sent to the top of column 31 as reflux.

To adapt the process of FIG. 6 to operate according to an embodiment of the invention, FIG. 7 shows the necessary changes. Both figures show the vaporization of oxygen rich liquid and/or nitrogen rich liquid in the heat exchanger, possibly involving a pumping step. Gaseous nitrogen is also warmed in the heat exchanger 4. Stream 75 is compressed in compressor 33 and sent to the warm end of the heat exchanger 4. It is cooled by passing through the whole heat exchanger to the cold end where it is separated. Part of the nitrogen 77 is expanded in the turbine 7 before being expanded into the top of the first column 31. The rest of the nitrogen 77, in liquid form is expanded in valve 9 (or alternative as previously described for air) to a pressure between 15 and 65 bara, is vaporized as stream 10 in the heat exchanger and warmed to between −70° C. and −140° C. before being mixed with a cooling nitrogen stream 77 from compressor 32 at a temperature between −70° C. and −140° C. The mixed stream 79 is expanded in turbine 34 and partially condensed.

A gaseous nitrogen stream 27 from the column 31 and/or 33 is warmed in the heat exchanger 4 (not shown).

The heat exchanger 4 may be split into first and second heat exchange sections (not shown). The compressed and purified air is cooled at the first pressure in the first heat exchange section and the cooled air is sent from the first heat exchange section to the column system comprising at least one distillation column. Gaseous nitrogen 27 from the column system is warmed in the first and/or second heat exchange sections. The liquid stream 25 enriched in oxygen or nitrogen from the column system is vaporized and warmed in the first heat exchange section. The first gaseous stream having a nitrogen content at least that of air and at a higher pressure than the first pressure is cooled and liquefied or pseudo liquefied in the second heat exchange section to form a liquefied stream. At least part of the liquefied stream 10 is warmed and preferably vaporized in the second heat exchange section to the first intermediate temperature of the second heat exchange section to form the vaporized stream. The second gaseous stream 15 having the same nitrogen content as the first stream is cooled in the second heat exchange section. At least part of the second gaseous stream is removed from the second heat exchange section at the second intermediate temperature.

The heat exchanger is preferably comprised of first and second heat exchange sections wherein any warming air stream, cooling air stream or warming stream produced by the column system above a given pressure is cooled or warmed respectively in the first heat exchange section. Other streams may be cooled or warmed in either of the two heat exchange sections. Thus the first section will have a more robust structure than the second section.

All of the FIGS. 3,5,6 and 7 may be modified to divide the heat exchanger into two sections, one of which receives all the streams above a given pressure sent to or coming from the column system. The other section receives no stream above the given pressure but receives streams at a pressure below the given pressure. The section receiving all streams above the given pressure may also receive at least one stream at below the given pressure.

Although in the examples both streams sent to the turbine have the same composition, it is possible for the streams to have different compositions. For example, one may be an air stream and the other a nitrogen stream.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A process for the separation of air by cryogenic distillation in which:

i) compressed and purified air is cooled at a first pressure in a heat exchanger and the cooled air is sent in gaseous form from the heat exchanger to a column system comprising at least one distillation column ii) warming a gaseous nitrogen stream from the column system in the heat exchanger;

iii) vaporizing a liquid stream enriched in oxygen or nitrogen from the column system and then warming the vaporized liquid stream in the heat exchanger;

iv) cooling and either liquefying or pseudo-liquefying a first gaseous stream having a nitrogen content at least that of air and at a higher pressure than the first pressure in the heat exchanger to form a liquefied stream;

v) warming and vaporizing at least part of the liquefied stream of step iv) in the heat exchanger to a first intermediate temperature of the heat exchanger to form a vaporized stream;

vi) expanding the vaporized stream, at least in part, in a turbine to form an expanded stream and then sending at least part of the expanded stream to the column system;

vii) cooling a second gaseous stream having the same nitrogen content as the first stream in the heat exchanger, removing at least part of the second gaseous stream from the heat exchanger at a second intermediate temperature and then sending the at least part of the second gaseous stream to the turbine to be expanded with the vaporized stream; and viii) liquefying or pseudo-liquefying a further stream having a nitrogen content at least that of air in the heat exchanger, then expanding and sending the further stream to the column system.

2. The process according to claim 1, wherein the column system comprises a first column operating at a pressure no more than 4 bars below the first pressure, and a second column operating at a second pressure lower than the pressure of the first column.

3. The process according to claim 2, wherein the first gaseous stream at the higher pressure and the second gaseous stream are both air streams and the expanded stream of step v) is sent to the first column.

4. The process according to claim 2, wherein the first gaseous stream at the higher pressure and the second gaseous stream are both nitrogen rich streams having a nitrogen content richer than that of air, at least one of which having being withdrawn from the first and/or second column.

5. The process according to claim 1, wherein the first intermediate temperature is higher than the second intermediate temperature, equal to the second intermediate temperature or less than the second intermediate temperature.

6. The process according to claim 1, wherein a gaseous stream is compressed in a first compressor to a second pressure that is higher than the first pressure and then divided to form the first and second gaseous streams.

7. The process according to claim 6, wherein the first gaseous stream is further compressed in a second compressor to a third pressure higher than the second pressure before being cooled in the heat exchanger.

8. The process according to claim 7, wherein the second compressor is coupled to the turbine.

9. The process according to claim 6, wherein the second gaseous stream is cooled in the heat exchanger at the second pressure.

10. The process according to claim 6, wherein the second pressure is the inlet pressure of the turbine.

11. The process according to claim 1, wherein the first pressure is substantially equal to the pressure of the at least one distillation column of the column system operating at the highest or higher pressure.

12. The process according to claim 1, wherein the outlet pressure of the turbine is substantially equal to the pressure of the at least one distillation column of the column system operating at the highest or higher pressure.

13. The process according to claim 1, wherein the heat exchanger is comprised of first and second heat exchange sections, wherein the compressed and purified air is cooled at the first pressure in the first heat exchange section and the cooled air is sent from the first heat exchange section to the column system comprising at least one distillation column, wherein gaseous nitrogen stream from the column system is warmed in the first and/or second heat exchange sections, wherein the liquid stream enriched in oxygen or nitrogen from the column system is vaporized and warmed in the first heat exchange section, wherein the first gaseous stream having a nitrogen content at least that of air and at a higher pressure than the first pressure is cooled and liquefied or pseudo liquefied in the second heat exchange section to form a liquefied stream, wherein at least part of the liquefied stream is warmed and preferably vaporized in the second heat exchange section to the first intermediate temperature of the second heat exchange section to form the vaporized stream, wherein the second gaseous stream having the same nitrogen content as the first stream is cooled in the second heat exchange section and at least part of the second gaseous stream is removed from the second heat exchange section at the second intermediate temperature.

14. The process according to claim 1, wherein the heat exchanger is comprised of first and second heat exchange sections wherein any warming air stream, cooling air stream or warming stream produced by the column system above a given pressure is cooled or warmed respectively in the first heat exchange section.

15. An apparatus for the separation of air by cryogenic distillation comprising:

a column system comprising at least one column, a heat exchanger, a turbine;

means for sending compressed and purified air at a first pressure to be cooled at the first pressure in the heat exchanger;

means for sending the cooled air in gaseous form from the heat exchanger to the column system;

means for sending a gaseous nitrogen stream from the column system to be warmed in the heat exchanger;

means for sending a liquid stream enriched in oxygen or nitrogen from the column system to be vaporized and warmed in the heat exchanger;

means for sending a first gaseous stream having a nitrogen content at least that of air and at a higher pressure than the first pressure to be cooled and liquefied or pseudo liquefied in the heat exchanger to form a liquefied stream;

means for sending at least part of the liquefied stream to be warmed and vaporized in the heat exchanger to a first intermediate temperature of the heat exchanger to form a vaporized stream;

means for removing the vaporized stream from an intermediate section of the heat exchanger;

a conduit for sending the vaporized stream to be expanded, at least in part, in the turbine to form an expanded stream;

a conduit for sending at least part of the expanded stream to the column system, a conduit for sending a second gaseous stream having the same nitrogen content as the first stream to be cooled in the heat exchanger;

conduit means for removing at least part of the second gaseous stream from an intermediate section of the heat exchanger at a second intermediate temperature and sending the at least part of the second gaseous stream to the turbine to be expanded with the vaporized stream;

conduit means for sending a further stream having a nitrogen content at least that of air to be liquefied or pseudo-liquefied in the heat exchanger;

expansion means; and means for sending the further stream to the expansion means and conduit means for sending the expanded further stream to the column system.

* * * * *